US012584408B1

(12) United States Patent
Dai et al.

(10) Patent No.: US 12,584,408 B1
(45) Date of Patent: Mar. 24, 2026

(54) FORMATION FLUID SAMPLING USING PROBE WITH INFLATABLE PAD

(71) Applicant: Halliburton Energy Services, Inc., Houston, TX (US)

(72) Inventors: Bin Dai, Katy, TX (US); Wael Soliman Mohamed Elhawary, Katy, TX (US); Christopher Michael Jones, Katy, TX (US); Zhonghuan Chen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/061,427

(22) Filed: Feb. 24, 2025

(51) Int. Cl.
*E21B 49/08* (2006.01)

(52) U.S. Cl.
CPC ..... *E21B 49/088* (2013.01)

(58) Field of Classification Search
CPC ..... E21B 49/10; E21B 49/088
See application file for complete search history.

(56) References Cited

U.S. PATENT DOCUMENTS 6,301,959 B1 10/2001 Hrametz et al.
7,121,338 B2 10/2006 van Zuilekom et al.
8,162,052 B2 * 4/2012 Goodwin ..... E21B 33/127 166/264
2009/0255671 A1 * 10/2009 Georgi ..... E21B 49/10 166/264
2010/0155061 A1 6/2010 Zazovsky et al.
2011/0198078 A1 * 8/2011 Harrigan ..... E21B 49/087 166/254.2
2015/0068736 A1 3/2015 Dirksen et al.
2015/0090446 A1 * 4/2015 Daito ..... E21B 49/10 166/264
2016/0130927 A1 * 5/2016 Waid ..... E21B 43/114 166/185
2017/0022809 A1 * 1/2017 Garcia ..... E21B 49/10
(Continued)

OTHER PUBLICATIONS

Halliburton. "Wireline Openhole Logging—Reservoir Description Tool (RDT) tool." Halliburton Company Website, https://www.halliburton.com/en/products/reservoir-description-tool-rdt-tool. Accessed Aug. 1, 2025.

(Continued)

*Primary Examiner* — Shane Bomar
(74) *Attorney, Agent, or Firm* — John Wustenberg; C. Tumey Law Group PLLC

(57) ABSTRACT

Disclosed herein are systems and methods to obtain representative reservoir fluid samples faster. In embodiments, a formation testing tool, which includes a probe and a fluid passageway, is conveyed in a wellbore and the probe is pressed against the wellbore to create a fluidic seal in between the formation and the fluid passageway. The reservoir fluid is then pumped from the formation to the fluid passageway. The probe comprises a rubber disposed on an outer perimeter of the probe and an inflatable barrier disposed between the rubber and a central area of the probe. After reaching a first pre-determined value of drilling fluid contamination, the inflatable barrier of the probe is inflated. Sampling of the reservoir fluid is performed after reaching a second value of drilling fluid contamination in the reservoir fluid pumped from the formation to the fluid passageway.

14 Claims, 10 Drawing Sheets

(56) References Cited

U.S. PATENT DOCUMENTS

| | | | | |
|---|---|---|---|---|
| 2020/0072048 | A1* | 3/2020 | Harte | E21B 49/088 |
| 2020/0308965 | A1* | 10/2020 | Al Dawood | E21B 49/10 |
| 2022/0178251 | A1 | 6/2022 | De Gennaro et al. | |
| 2022/0243588 | A1* | 8/2022 | Hudson | E21B 49/008 |
| 2024/0254877 | A1* | 8/2024 | Jones | E21B 43/10 |
| 2024/0352856 | A1 | 10/2024 | Arian et al. | |

OTHER PUBLICATIONS

Halliburton YouTube Video. "Halliburton Reservoir Description Tool (RDT) Device." Uploaded Jan. 13, 2014. YouTube Website, https://www.youtube.com/watch?v=Qd7F8TOIVXU. Accessed Aug. 1, 2025.

International Search Report and Written Opinion for International Patent Application No. PCT/US2025/018911 dated Nov. 13, 2025. PDF file. 11 pages.

* cited by examiner

FORMATION FLUID SAMPLING USING PROBE WITH INFLATABLE PAD

BACKGROUND

During oil and gas exploration, many types of information may be collected and analyzed. The information may be used to determine the quantity and quality of hydrocarbons in a reservoir and to develop or modify strategies for hydrocarbon production. For instance, the information may be used for reservoir evaluation, flow assurance, reservoir stimulation, facility enhancement, production enhancement strategies, and reserve estimation. One technique for collecting relevant information involves pressure testing a reservoir of interest at any specified depth and reservoir fluid collection. There are a variety of different tools such as formation testing tools that may be used to perform downhole formation sampling and pressure measurements. Formation testing tools may be conveyed downhole in a variety of ways, including wireline and drill string. Formation testing tools determine the formation pore pressure, estimate the formation mobility (ratio of permeability over viscosity or k/u), and can collect samples of reservoir fluids. The collected representative reservoir fluids are then sent to a surface laboratory to conduct PVT and compositional analysis. Therefore, it is important to obtain clean and representative reservoir fluid sample in a timely fashion as contaminated samples lead to inaccurate analysis results and erroneous reservoir assessments.

During the drilling process, a specialized drilling fluid, commonly referred to as "drilling mud," is used to lubricate the drill bit, carry cuttings to the surface, and maintain wellbore stability. However, drilling mud is not a static component as it can inadvertently infiltrate the surrounding formation rock, leading to a phenomenon known as "drilling fluid filtrate invasion." This invasion poses a significant challenge for formation testers seeking to obtain clean and representative reservoir fluid samples. Traditional methods of formation fluid sampling often involve using formation tester equipped with point probes and/or dual packers, depending upon the expected formation fluid mobility. In low formation fluid mobility, the formation testing tools may operate a long time (up to several hours) to obtain a representative reservoir fluid sample as it takes a long time to pump the drilling fluid filtrate out of the reservoir fluid and decrease its content in the extracted reservoir fluid. However, long waiting times with a stationary tool are undesirable in field operations as they increase both the rig time and the risk of differential tool sticking. Nevertheless, the information that formation testing tools can deliver is sufficiently valuable to operators that many are willing to wait, even hours, to obtain representative reservoir fluid sample with no or relatively low drilling fluid filtrate contamination.

To further reduce sampling time, the oil service industry may provide a type of point probe called focused probe pad, with inner and outer flowing areas separated by a rubber barrier. The outer flowing area serves as guarding probe that actively absorbs drilling fluid filtrate and prevents near wellbore drilling fluid filtrate from entering the inner flow area or clean probe, so that the drilling fluid filtrate content can be quickly reduced in the clean probe during the pump-out stage, enabling faster clean up than the one obtained with conventional non-focused probe. However, focused probe pad requires two set of pumps and flowlines, one for guarding probe and the other for clean probe, which significantly increase cost, tool weight, and system complexity.

BRIEF DESCRIPTION OF THE DRAWINGS

These drawings illustrate certain aspects of some of the embodiments of the present disclosure, and should not be used to limit or define the disclosure.

DETAILED DESCRIPTION

Figure 1:
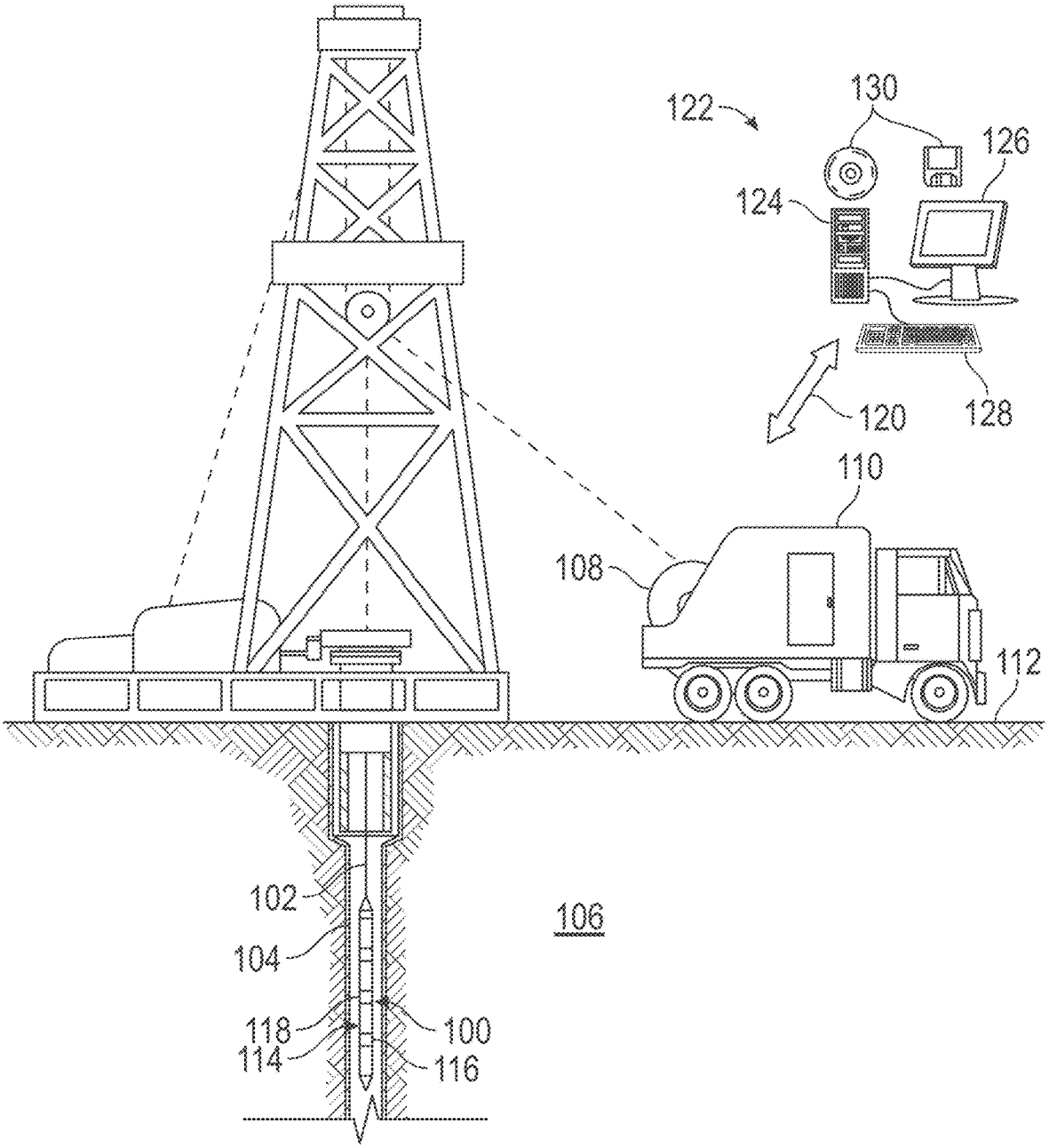
FIG. 1 is a schematic diagram of an example of a fluid sampling tool on a wireline.

Disclosed herein are systems and methods to obtain representative reservoir fluid samples faster using a new probe design and operating procedure requiring only one flow line and one pump in the formation testing tool. More specifically, the probe comprises an inflatable barrier that reduces the probe outer flow area to concentrate the flow of formation fluid being pumped into the formation testing tool into a central flow area. The inflatable barrier may be made of any material capable of withstanding differential pressure and providing a fluidic seal with the wellbore or borehole including rubber, wire mesh, Kevlar®, or any combination thereof, for example. The inflatable barrier may withstand differential pressure from 10 psi (68,948 Pa) to 30 kpsi (206,842,800 Pa), from 500 psi (3,447,380 Pa) to 20 kpsi (137,895,200 Pa), from 1 kpsi (6,894,760 Pa) to 10 kpsi (68,947,600 Pa), from 2 kpsi (13,789,520 Pa) to 5 kpsi (34,473,800 Pa), or any range in between, for example. The inflatable barrier may have any geometry or shape adapted to the borehole or wellbore, the reservoir anisotropy, the reservoir heterogeneity, and the reservoir connectivity including circular shape, rectangular shape, elliptical shape, or any combination thereof, for example. Further, the shape of the inflatable barrier may be modified in real time depending upon its consequence on the flow of the formation fluid into the central flow area of the probe by pumping or injecting a hydraulic fluid or any fluid capable of inflating each parts of the inflatable barrier. The shape of the inflatable barrier may be tunable by dividing the inflatable barrier into inflatable parts leading to any shape including circular, rectangular, or elliptical shape, for example. The inflatable barrier may be inflated to form a circular shape first, then an elliptical shape, and then a rectangular shape, for example.

At the beginning of the pump-out operation, the field engineer operates the formation testing tool the same way as any conventional probe until reaching a pre-determined value of drilling fluid filtrate contamination. The pre-determined amount of drilling fluid filtrate contamination may be any amount including around 35%, around 30%, around 25%, around 20%, around 15%, around 12%, around 10%, around 8%, around 5%, or any value in between, for example. Then, the inflatable barrier is inflated to form a pre-determined shape depending upon the borehole or wellbore, the angle between the probe and the borehole, the reservoir anisotropy, the reservoir heterogeneity, the reservoir connectivity, or any combination thereof, to concentrate the flow of formation fluid being pumped into the formation testing tool into a central flow area. This reduction of the flow area creates a strong guarding effect and pull dirty fluid including drilling fluid filtrate contamination away from the central flow area of the probe. The reduction of the flow area may be from 5% of the original surface area to 95% of the original surface area, from 10% to 90%, from 20% to 80%, from 30% to 70%, from 35% to 65%, from 40% to 60%, from 45% to 55%, or 50% of the original surface area, for example. The trigger to inflate the inflatable barrier may be based on a pre-determined value of drilling fluid filtrate contamination, or alternatively, after a certain amount of time including after 10 minutes, 20 minutes, 30 minutes, 45 minutes, one hour, 90 minutes, 2 hours, or any value in between. This strategic modification of the flow area between the probe and the formation with a focus on reducing the outer flow area and concentrating the reservoir fluid being pumped into the central flow area, offers a transformative advantage in downhole formation fluid sampling. It enhances sample purity, sample representativeness, and operational efficiency while minimizing non-productive time, risk of tool sticking, formation of fluid waste, and its associated environmental impact.

Contamination from drilling fluid filtrate may be differentiated from reservoir fluid using various measurement sensors including densitometer sensor, resistivity sensor, optical sensor, viscosity sensor, Nuclear Magnetic Resonance (NMR) sensor, acoustic sensor (measuring the speed of sound), for example. For example, densitometer sensors may be desired to differentiate drilling fluid filtrate from reservoir fluid due to their contrasting densities.

In embodiments, a system comprises a non-transitory computer readable medium having data stored therein representing a software executable by a computer. The software executable includes instructions configured to pumping reservoir fluid from the downhole formation from the probe to the flow line of the formation testing tool at a flow rate, until reaching a first pre-determined value of contamination of drilling fluid filtrate, then inflating the inflatable barrier to concentrate the reservoir fluid from the downhole formation into a central area of the probe, and sampling a reservoir fluid when reaching a second pre-determined value of contamination of drilling fluid filtrate inside the reservoir fluid being pumped inside the probe. In embodiments, the shape of the inflatable barrier is modified in real time to a second geometry such as from circular shape to an elliptical shape and/or from an elliptical shape to a rectangular shape, for example, by inflating successive parts of the inflatable barrier. In some embodiments, the system comprising the non-transitory computer readable medium having data stored therein representing a software executable by a computer is autonomous and performs these successive steps based on pre-determined values of contamination of drilling fluid filtrate inside the reservoir fluid pumped inside the probe.

FIG. 1 is a schematic diagram of fluid sampling tool 100 on a conveyance 102. As illustrated, wellbore 104 may extend through subterranean formation 106. In examples, reservoir fluid may be contaminated with well fluid (e.g., drilling fluid) from wellbore 104. As described herein, the fluid sample may be analyzed to determine fluid contamination and other fluid properties of the reservoir fluid. As illustrated, wellbore 104 may extend through subterranean formation 106. While the wellbore 104 is shown extending generally vertically into subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run fluid sampling tool 100 into wellbore 104. Hoist 108 may be disposed on a vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Fluid sampling tool 100 may be suspended in wellbore 104 on conveyance 102. Other conveyance types may be used for conveying fluid sampling tool 100 into wellbore 104, including coiled tubing and wired drill pipe, conventional drill pipe for example. Fluid sampling tool 100 may comprise a tool body 114, which may be elongated as shown on FIG. 1. Tool body 114 may be any suitable material, including without limitation titanium, stainless steel, alloys, plastic, any combinations thereof, and the like. Fluid sampling tool 100 may further include one or more sensors 116 for measuring properties of the fluid sample, reservoir fluid, wellbore 104, subterranean formation 106, or the like. In examples, fluid sampling tool 100 may also include a fluid analysis module 118, which may be operable to process information regarding fluid sample, as described below. The fluid sampling tool 100 may be used to collect fluid samples from subterranean formation 106 and may obtain and separately store different fluid samples from subterranean formation 106.

In examples, fluid analysis module 118 may comprise at least one sensor that may continuously monitor a reservoir fluid. Such sensors include optical sensors, acoustic sensors, electromagnetic sensors, conductivity sensors, resistivity sensors, a capacitance sensor, selective electrodes, density sensors, mass sensors, thermal sensors, chromatography sensors, viscosity sensors, bubble point sensors, fluid compressibility sensors, flow rate sensors. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra and translate such measurements into component concentrations of the fluid sample, which may be lumped component concentrations, as described above. The fluid analysis module 118 may also measure gas-to-oil ratio, fluid composition, water cut, live fluid density, live fluid viscosity, formation pressure, and formation temperature. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, fluid analysis module 118 may include random access memory (RAM), one or more processing units, such as a central processing unit (CPU), or hardware or software control logic, ROM, and/or other types of nonvolatile memory.

Any suitable technique may be used for transmitting phase signals from the fluid sampling tool 100 to the surface 112. As illustrated, a communication link 120 (which may be wired or wireless, for example) may be provided that may transmit data from fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. The information handling system 122 may act as a data acquisition system and possibly a data processing system that analyzes information from fluid sampling tool 100. For example, information handling system 122 may process the information from fluid sampling tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole hole or at surface 112 or another location after recovery of fluid sampling tool 100 from wellbore 104. Alternatively, the processing may be performed by an information handling system in wellbore 104, such as fluid analysis module 118. The resultant fluid contamination and fluid properties may then be transmitted to surface 112, for example, in real-time.

Figure 2:
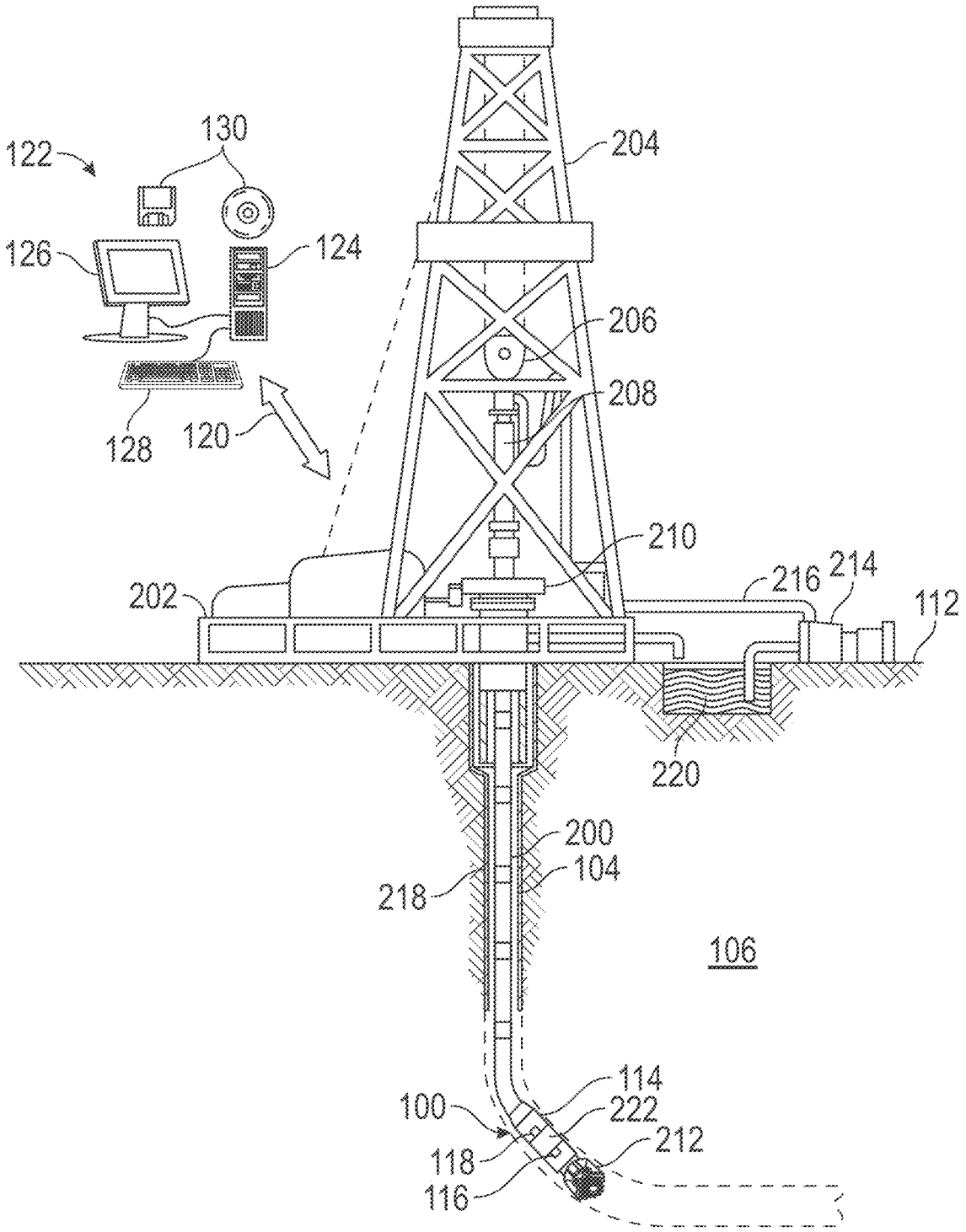
FIG. 2 is a schematic diagram of an example of the fluid sampling tool on a drill string.

Referring now to FIG. 2, a schematic diagram illustrates a fluid sampling tool 100 disposed on a drill string 200 in a drilling operation. Fluid sampling tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may comprise roller conc bits, PDC bits, natural diamond bits, any hole openers, reamers, coring bits, and the like. As drill bit 212 rotates, it may create and extend wellbore 104 that penetrates various subterranean formations 106. A pump 214 may circulate drilling fluid through a feed pipe 216 to kelly 208, downhole through the interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and fluid sampling tool 100. Fluid sampling tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, any combinations thereof, and the like. Fluid sampling tool 100 may be similar in configuration and operation to fluid sampling tool 100 shown on FIG. 1 except that FIG. 2 shows fluid sampling tool 100 disposed on drill string 200. Alternatively, fluid sampling tool 100 may be lowered into the wellbore after drilling operations on a wireline.

Fluid sampling tool 100 may further include one or more sensors 116 for measuring properties of the fluid sample reservoir fluid, wellbore 104, subterranean formation 106, or the like. The properties of the fluid are measured as the fluid passes from the formation through the tool and into either the wellbore or a sample container. As fluid is flushed in the near wellbore region by the mechanical pump, the fluid that passes through the tool generally reduces its drilling fluid filtrate content, and generally increases its formation fluid content. The fluid sampling tool 100 may be used to collect a fluid sample from subterranean formation 106 when the filtrate content has been determined to be sufficiently low. Sufficiently low depends on the purpose of sampling. For some laboratory testing, below 10% drilling fluid contamination is sufficiently low, while for other testing, below 1% drilling fluid filtrate contamination is sufficiently low. Sufficiently low also depends on the nature of the formation fluid such that lower requirements are generally needed, the lighter the oil as designated with either a higher GOR or a higher API gravity. Sufficiently low also depends on the rate of cleanup in a cost benefit analysis since longer pump out times utilized to incrementally reduce the contamination levels may have prohibitively large costs. As previously described, the fluid sample may comprise a reservoir fluid, which may be contaminated with a drilling fluid or drilling fluid filtrate. Fluid sampling tool 100 may obtain and separately store different fluid samples from subterranean formation 106 with fluid analysis module 118. Fluid analysis module 118 may operate and function in the same manner as described above. However, storing the fluid samples in fluid sampling tool 100 may be based on the determination of the fluid contamination. For example, if the fluid contamination exceeds a tolerance, then the fluid sample may not be stored. If the fluid contamination is within a tolerance, then the fluid sample may be stored in fluid sampling tool 100.

As previously described, information from fluid sampling tool 100 may be transmitted to an information handling system 122, which may be located at surface 112. As illustrated, communication link 120 (which may be wired or wireless, for example) may be provided that may transmit data from fluid sampling tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate clean fluid composition.

Figure 3:
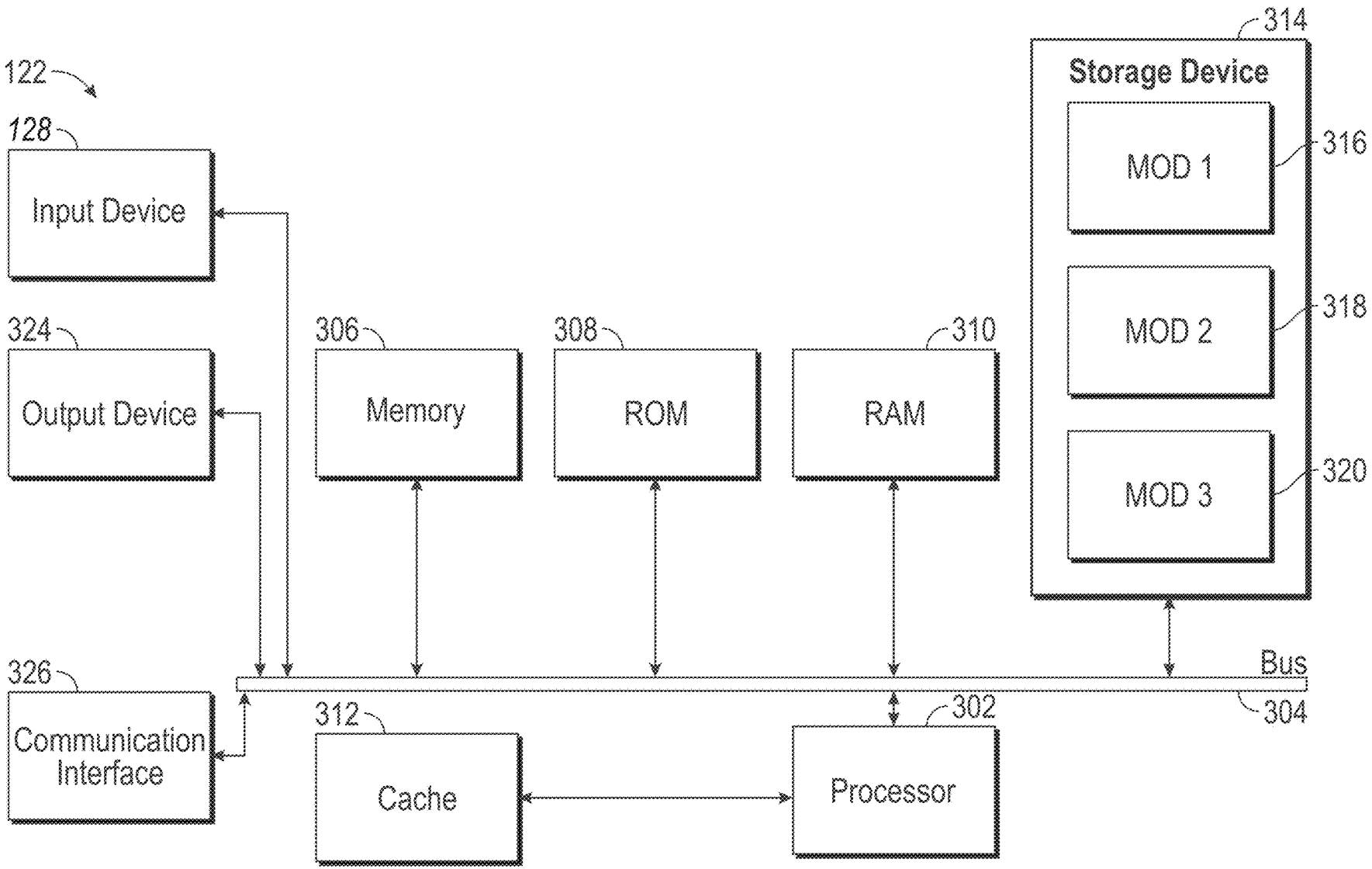
FIG. 3 is a schematic of an information handling system.

FIG. 3 illustrates information handling system 122 which may be employed to perform various blocks, methods, and techniques disclosed herein. As illustrated, information handling system 122 includes a processing unit (CPU or processor) 302 and a system bus 304 that couples various system components including system memory 306 such as read only memory (ROM) 308 and random-access memory (RAM) 310 to processor 302. Processors disclosed herein may all be forms of this processor 302. Information handling system 122 may include a cache 312 of high-speed memory connected directly with, in close proximity to, or integrated as part of processor 302. Information handling system 122 copies data from system memory 306 and/or storage device 314 to cache 312 for quick access by processor 302. In this way, cache 312 provides a performance boost that avoids processor 302 delays while waiting for data. These and other modules may control or be configured to control processor 302 to perform various operations or actions. Other system memory 306 may be available for use as well. System memory 306 may include multiple different types of memory with different performance characteristics. It may be appreciated that the disclosure may operate on information handling system 122 with more than one processor 302 or on a group or cluster of computing devices networked together to provide greater processing capability. Processor 302 may include any general-purpose processor and a hardware module or software module, such as first module 316, second module 318, and third module 320 stored in storage device 314, configured to control processor 302 as well as a special-purpose processor where software instructions are incorporated into processor 302. Processor 302 may be a self-contained computing system, containing multiple cores or processors, a bus, memory controller, cache, etc. A multi-core processor may be symmetric or asymmetric. Processor 302 may include multiple processors, such as a system having multiple, physically separate processors in different sockets, or a system having multiple processor cores on a single physical chip. Similarly, processor 302 may include multiple distributed processors located in multiple separate computing devices but working together such as via a communications network. Multiple processors or processor cores may share resources such as system memory 306 or cache 312 or may operate using independent resources. Processor 302 may include one or more state machines, an application specific integrated circuit (ASIC), or a programmable gate array (PGA) including a field PGA (FPGA).

Each individual component discussed above may be coupled to system bus 304, which may connect each and every individual component to each other. System bus 304 may be any of several types of bus structures including a memory bus or memory controller, a peripheral bus, and a local bus using any of a variety of bus architectures. A basic input/output (BIOS) stored in ROM 308 or the like, may provide the basic routine that helps to transfer information between elements within information handling system 122, such as during start-up. Information handling system 122 further includes storage devices 314 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 314 may include software modules 316, 318, and 320 for controlling processor 302. Information handling system 122 may include other hardware or software modules. Storage device 314 is connected to the system bus 304 by a drive interface. The drives and the associated computer-readable storage devices provide nonvolatile storage of computer-readable instructions, data structures, program modules and other data for information handling system 122. In one aspect, a hardware module that performs a particular function includes the software component stored in a tangible computer-readable storage device in connection with the necessary hardware components, such as processor 302, system bus 304, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 122 is a small, handheld computing device, a desktop computer, or a computer server. When processor 302 executes instructions to perform "operations", processor 302 may perform the operations directly and/or facilitate, direct, or cooperate with another device or component to perform the operations.

As illustrated, information handling system 122 employs storage device 314, which may be a hard disk or other types of computer-readable storage devices which may store data that are accessible by a computer, such as magnetic cassettes, flash memory cards, digital versatile disks (DVDs), cartridges, random access memories (RAMs) 310, read only memory (ROM) 308, a cable containing a bit stream and the like, may also be used in the exemplary operating environment. Tangible computer-readable storage media, computer-readable storage devices, or computer-readable memory devices, expressly exclude media such as transitory waves, energy, carrier signals, EM waves, and signals per se.

To enable user interaction with information handling system 122, an input device 128 represents any number of input mechanisms, such as a microphone for speech, a touch-sensitive screen for gesture or graphical input, keyboard, mouse, motion input, speech and so forth. Additionally, input device 128 may receive acoustic or EM measurements from fluid sampling tool 100 (e.g., referring to FIGS. 1 and 2), discussed above. An output device 324 may also be one or more of a number of output mechanisms known to those of skill in the art. In some instances, multimodal systems enable a user to provide multiple types of input to communicate with information handling system 122. Communications interface 326 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 302, that is purpose-built to operate as an equivalent to software executing on a general-purpose processor. For example, the functions of one or more processors presented in FIG. 5 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 308 for storing software performing the operations described below, and random-access memory (RAM) 310 for storing results. Very large-scale integration (VLSI) hardware embodiments, as well as custom VLSI circuitry in combination with a general-purpose DSP circuit, may also be provided.

Figure 4:
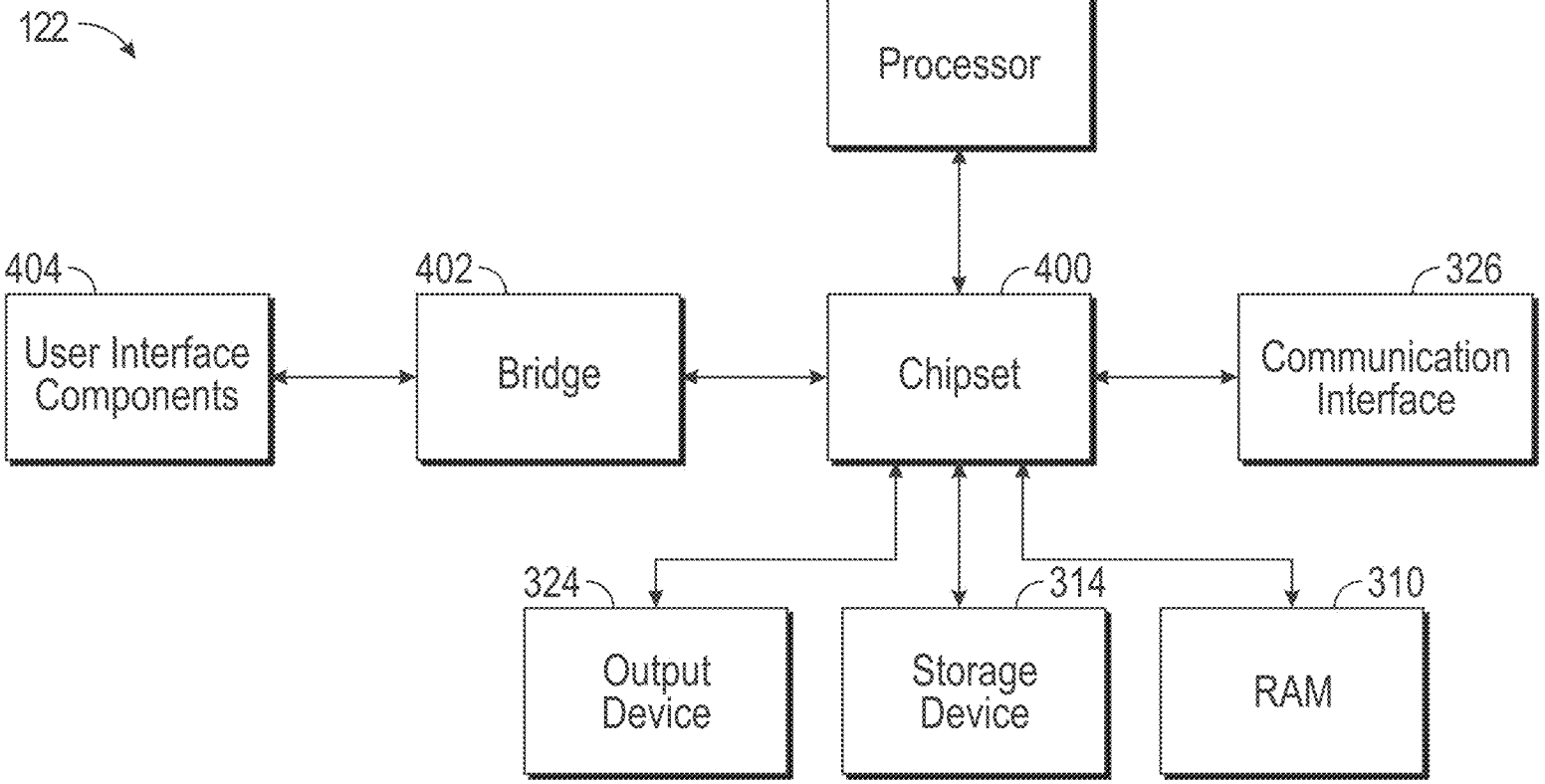
FIG. 4 is a schematic of a chipset that may be utilized by the information handling system.

FIG. 4 illustrates an example information handling system 122 having a chipset architecture for information handling system 122 that may be used in executing the described method and generating and displaying a graphical user interface (GUI). Information handling system 122 is an example of computer hardware, software, and firmware that may be used to implement the disclosed technology. Information handling system 122 may include a processor 302, representative of any number of physically and/or logically distinct resources capable of executing software, firmware, and hardware configured to perform identified computations. Processor 302 may communicate with a chipset 400, discussed below, that may control input to and output from processor 302. In this example, chipset 400 outputs information to output device 324, such as a display, and may read and write information to storage device 314, which may include, for example, magnetic media, and solid-state media. Chipset 400 may also read data from and write data to RAM 310. Bridge 402 for interfacing with a variety of user interface components 404 may be provided for interfacing with chipset 400. Such user interface components 404 may include a keyboard, a microphone, touch detection and processing circuitry, a pointing device, such as a mouse, and so on. In general, inputs to information handling system 122 may come from any of a variety of sources, machine generated and/or human generated.

Chipset 400 may also interface with one or more communication interfaces 326 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 302 analyzing data stored in storage device 314 or RAM 310. Further, information handling system 122 receives inputs from a user via user interface components 404 and executes appropriate functions, such as browsing functions by interpreting these inputs using processor 302.

In examples, information handling system 122 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing blocks of the methods disclosed herein. The particular sequence of such executable instructions or associated data structures represents examples of corresponding acts for implementing the functions described in such blocks.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Figure 5:
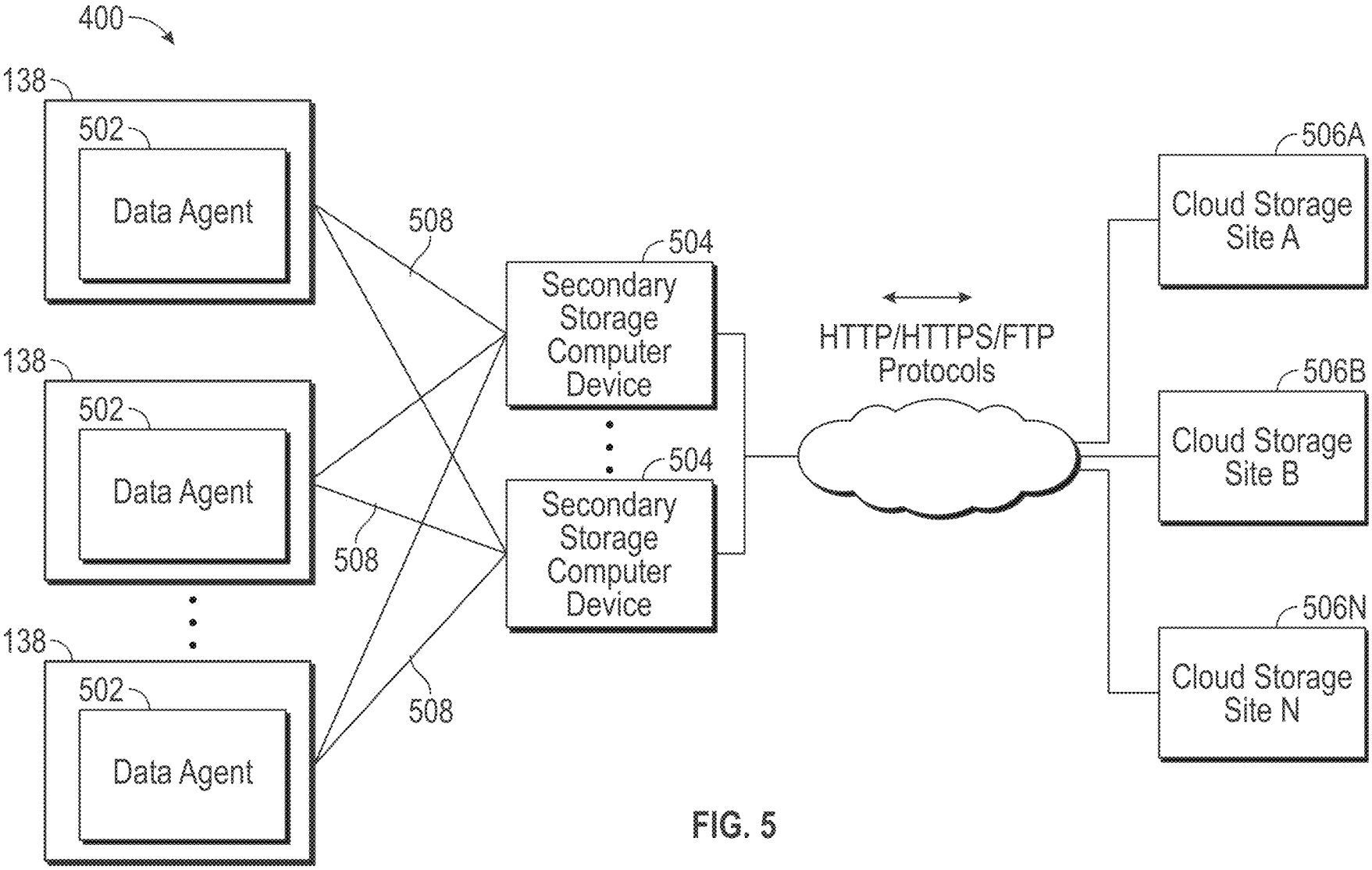
FIG. 5 is a schematic of an arrangement of resources on a computer network.

FIG. 5 illustrates an example of one arrangement of resources on a computing network 500 that may employ the processes and techniques described herein, although many others are of course possible. As noted above, an information handling system 122, as part of their function, may utilize data, which includes files, databases, directories, metadata (e.g., access control list (ACLS) creation/edit dates associated with the data, etc.), and other data objects. The data on the information handling system 122 is typically a primary copy (e.g., a production copy). During a copy, backup, archive or other storage operation, information handling system 122 may send a copy of some data objects (or some components thereof) to a secondary storage computing device 504 by utilizing one or more data agents 502.

A data agent 502 may be a desktop application, website application, or any software-based application that is run on information handling system 122. As illustrated, information handling system 122 may be disposed at any rig site (e.g., referring to FIG. 1), off site location, core laboratory, repair and manufacturing center, and/or the like. In examples, data agent 502 may communicate with a secondary storage computing device 504 using communication protocol 508 in a wired or wireless system. Communication protocol 508 may function and operate as an input to a website application. In the website application, field data related to pre- and post-operations, notes, and/or the like may be uploaded. Additionally, information handling system 122 may utilize communication protocol 508 to access processed measurements, operations with similar field conditions including similar tool and/or downhole conditions, troubleshooting findings, historical run data, and/or the like. This information is accessed from secondary storage computing device 504 by data agent 502, which is loaded on information handling system 122.

Secondary storage computing device 504 may operate and function to create secondary copies of primary data objects (or some components thereof) in various cloud storage sites 506A-N. Additionally, secondary storage computing device 504 may run determinative algorithms on data uploaded from one or more information handling systems 122, discussed further below. Communications between the secondary storage computing devices 504 and cloud storage sites 506A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 506A-N, the secondary storage computing device 504 may also perform local content indexing and/or local object-level, sub-object-level or block-level deduplication when performing storage operations involving various cloud storage sites 506A-N. Cloud storage sites 506A-N may further record and maintain, EM logs, geometry or shape of the inflatable pad in previous operations including fluid sampling tool geometry and downhole field conditions, store repair and maintenance data, store operational data, and/or provide outputs from determinative algorithms that are located in cloud storage sites 506A-N. In a non-limiting example, this type of network may be utilized as a platform to store, backup, analyze, import, perform extract, transform and load ("ETL") processes, mathematically process, apply machine learning models, and augment data sets. Based on previous fluid sampling tool geometry and downhole field conditions, information handling system 122 may suggest preferred shape of the inflatable barrier for the next sampling zone to the operator, for example. In embodiments, information handling system 122 is autonomous and chose the shape of the inflatable barrier based on previous fluid sampling tool geometry and downhole field conditions.

Figure 6:
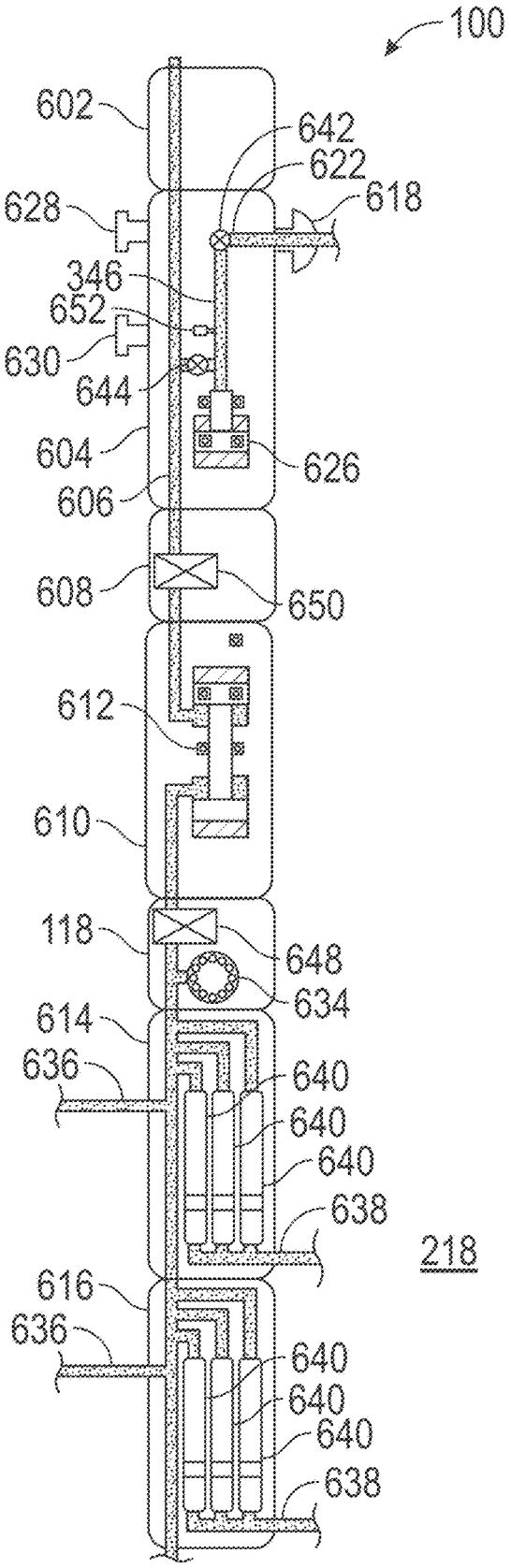
FIG. 6 is a schematic of a fluid sampling tool according to embodiments of the present disclosure.

FIG. 6 is a schematic of fluid sampling tool 100. In some embodiments, fluid sampling tool 100 includes a power telemetry section 602 through which the tool communicates with other actuators and sensors 116 in drill string 200 or conveyance 102 (e.g., referring to FIGS. 1 and 2), the drill string's telemetry section 602, and/or directly with a surface telemetry system (not illustrated). In examples, power telemetry section 602 may also be a port through which the various actuators (e.g., valves) and sensors (e.g., temperature and pressure sensors) in fluid sampling tool 100 may be controlled and monitored. In examples, power telemetry section 602 includes a computer that exercises the control and monitoring function. In one embodiment, the control and monitoring function is performed by a computer in another part of the drill string or wireline tool (not shown) or by information handling system 122 on surface 112 (e.g., referring to FIGS. 1 and 2).

In examples, fluid sampling tool 100 includes a dual probe section 604, which extracts fluid from the reservoir and delivers it to fluid passageway 606 that extends from one end of fluid sampling tool 100 to the other. Without limitation, probe section 604 includes probe 618 which may extend from fluid sampling tool 100 and press against the inner wall of wellbore 104 (e.g., referring to FIG. 1). Probe channel 622 may connect probe 618 to fluid passageway 606. The high-volume bidirectional pump 612 may be used to pump fluids from the reservoir, through probe channel 622 and to fluid passageway 606. The high-volume bidirectional pump 612 may contain from 100 $cm^3$ to 1000 $cm^3$ of fluid, from 200 $cm^3$ to 800 $cm^3$, from 300 $cm^3$ to 700 $cm^3$, or any number in between. Alternatively, a low volume pump 626 may be used for this purpose. The low-volume pump 626 may contain from 10 $cm^3$ to 400 $cm^3$ of fluid, from 20 $cm^3$ to 300 $cm^3$, from 30 $cm^3$ to 200 $cm^3$, from 50 $cm^3$ to 100 $cm^3$, or any number in between. Two standoffs or stabilizers 628, 630 hold fluid sampling tool 100 in place as probe 618 presses against the wall of wellbore 104. In examples, probe 618 and stabilizers 628, 630 may be retracted when fluid sampling tool 100 may be in motion and probe 618 and stabilizers 628, 630 may be extended to sample the formation fluids at any suitable location or sampling zone in wellbore 104.

In examples, fluid passageway 606 may be connected to other tools disposed on drill string 200 or conveyance 102 (e.g., referring to FIGS. 1 and 2). In examples, fluid sampling tool 100 may also include a quartz gauge section 608, which may include sensors 116 to allow measurement of properties, such as temperature and pressure, of fluid in fluid passageway 606. Additionally, fluid sampling tool 100 may include a flow-control pump-out section 610, which may include a high-volume bidirectional pump 612 for pumping fluid through fluid passageway 606. In examples, fluid sampling tool 100 may include two multi-chamber sections 614, 616, referred to collectively as multi-chamber sections 614, 616 or individually as first multi-chamber section 614 and second multi-chamber section 616, respectively.

In examples, multi-chamber sections 614, 616 may be separated from flow-control pump-out section 610 by fluid analysis module 118, which may house at least one non-optical fluid sensor 648 and/or at least optical measurement tool 634. It should be noted that non-optical fluid sensor 648 and optical measurement tool 634 may be disposed in any order on fluid passageway 606. Additionally, although depicted in fluid analysis module 118, non-optical fluid sensor 648 and optical measurement tool 634 may be disposed along fluid passageway 606 at any suitable location within fluid sampling tool 100.

Non-optical fluid sensor 648 may be displaced within fluid analysis module 118 in-line with fluid passageway 606 to be a "flow through" sensor. In alternate examples, non-optical fluid sensor 648 may be connected to fluid passageway 606 via an offshoot of fluid passageway 606. Without limitation, non-optical fluid sensor 648 may include but not limited to the density sensor, capacitance sensor, resistivity sensor, and/or any combinations thereof. In examples, non-optical fluid sensor 648 may operate and/or function to measure fluid properties of drilling fluid filtrate.

Optical measurement tool 634 may be displaced within fluid analysis module 118 in-line with fluid passageway 606 to be a "flow through" sensor. In alternate examples, optical measurement tool 634 may be connected to fluid passageway 606 via an offshoot of fluid passageway 606. Without limitation, optical measurement tool 634 may include optical sensors, acoustic sensors, electromagnetic sensors, conductivity sensors, resistivity sensors, a capacitance sensor, selective electrodes, density sensors, mass sensors, thermal sensors, chromatography sensors, viscosity sensors, bubble point sensors, fluid compressibility sensors, flow rate sensors, microfluidic sensors, selective electrodes such as ion selective electrodes, and/or any combinations thereof. In example embodiments, optical measurement tool 634 may operate and/or function to measure drilling fluid filtrate as discussed further below.

Additionally, multi-chamber section 614, 616 may comprise access channel 636 and chamber access channel 638. Without limitation, access channel 636 and chamber access channel 638 may operate and function to either allow a solids-containing fluid (e.g., mud) disposed in wellbore 104 or provide a path for removing fluid from fluid sampling tool 100 into wellbore 104. As illustrated, multi-chamber sections 614, 616 may comprise a plurality of chambers 640. Chambers 640 may be sampling chamber that may be used to sample wellbore fluids, formation fluids, and/or the like during measurement and sampling operations.

During downhole measurement operations, a pump-out operation may be performed. A pump-out may be an operation where at least a portion of a fluid which may contain solids (e.g., drilling fluid, mud, filtrate etc.) may move through fluid sampling tool 100 until substantially increasing concentrations of non-contaminated reservoir fluids in fluid sampling tool 100. For example, during pump-out operations, probe 618 may be pressed against the inner wall of wellbore 104 (e.g., referring to FIG. 1). Pressure may increase at probe 618 due to compression against the formation 106 (e.g., referring to FIG. 1 or 2) exerting pressure on probe 618. As pressure rises and reaches a predetermined pressure, valve 642 opens so as to close equalizer valve 644, thereby isolating fluid passageway 606 from annulus 218 (e.g., referring to FIG. 2). In this manner, valve 642 ensures that equalizer valve 644 closes only after probe 618 has entered contact with mud cake (not illustrated) that is disposed against the inner wall of wellbore 104. In examples, as probe 618 is pressed against the inner wall of wellbore 104, the pressure rises and closes the equalizer valve 644 in fluid passageway 606, thereby isolating fluid passageway 606 from the annulus 218. In this manner, the equalizer valve 644 in fluid passageway 606 may close before probe 618 may have entered into contact with the mud cake that lines the inner wall of wellbore 104. Fluid passageway 606, now closed to annulus 218, is in fluid communication with low volume pump 626.

As low volume pump 626 is actuated, formation fluid may thus be drawn through probe 618 and probe channel 622. The movement of low volume pump 626 lowers the pressure in fluid passageway 606 to a pressure below the formation pressure, such that formation fluid is drawn through probe 618 and probe channel 622, and into fluid passageway 606. Probe 618 serves as a fluidic seal to prevent annular fluids from entering fluid passageway 606. Such an operation as described may take place before, after, during or as part of a sampling operation.

With low volume pump 626 in its fully retracted position and formation fluid drawn into fluid passageway 606, the pressure will stabilize and enable pressure sensor 652 to sense and measure formation fluid pressure. The measured pressure is transmitted to information handling system 122 disposed on formation testing tool 100 and/or it may be transmitted to the surface via mud pulse telemetry or by any other conventional telemetry means to information handling system 122 disposed on surface 112.

During this interval, pressure sensor 652 may continuously monitor the pressure in fluid passageway 606 until the pressure stabilizes, or after a predetermined time interval. When the measured pressure stabilizes, or after a predetermined time interval, for example at 1800 psi, and is sensed by pressure sensor 652, the drawdown operation may be complete.

Next, high-volume bidirectional pump 612 activates and equalizer valve 644 is opened. This allows for formation fluid to move toward high-volume bidirectional pump 612 through fluid passageway 606. Formation fluid moves through fluid passageway 606 to fluid analysis module 118. Once the drilling fluid filtrate has moved into fluid analysis module 118, high-volume bidirectional pump 612 may stop. This may allow for the presence of the drilling fluid filtrate to be measured by optical measurement tool 634 within fluid analysis module 118. Without limitation, any suitable properties of the formation fluid may be measured utilizing an optical measurement tool, for example.

High-volume bidirectional pump 612 ensures continued extraction of reservoir fluid from formation 106 while monitoring drilling fluid filtrate contamination present in reservoir fluid with fluid analysis module 118. Fluid analysis module 118 may include at least one sensor that may continuously monitor a reservoir fluid such as optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors. Sensors may measure a contrast between drilling fluid filtrate properties and formation fluid properties.

Figure 7A:
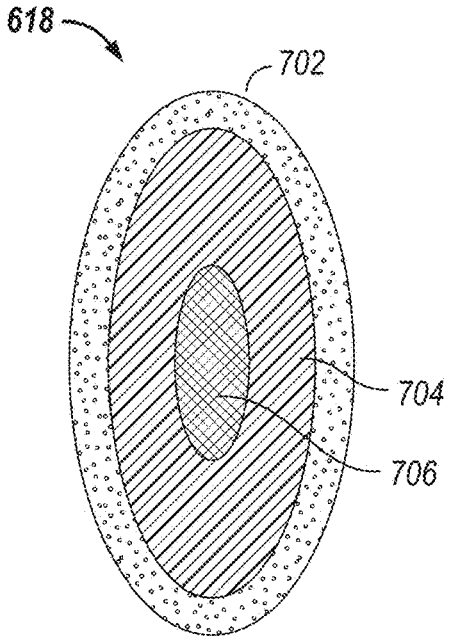
FIG. 7A is a schematic illustration of a probe according to embodiments of the present disclosure.

FIG. 7A is a schematic illustration of probe 618 according to embodiments of the present disclosure. As illustrated, probe 618 may comprise a rubber 702, an inflatable barrier 704, and a central flow area 706. Rubber 702 disposed on the outer perimeter of probe 618 may function and/or operate as a fluidic seal between formation testing tool 100 and wellbore 104 (referring to FIG. 1). Rubber 702 may be any rubber, elastomeric material, or high density material capable of expanding upon contact with the formation to create a fluidic seal between the probe and the formation. Rubber 702 may be of any shape including an elliptical shape, a circular shape, an oval shape, a square shape, a rectangular shape, for example. Rubber 702 may have a circular shape with a radius from about 0.5 inch to the borehole radius, from 1 inch to 10 inches, or from 1.5 inches to 5 inches, for example. Rubber 702 may be connected to probe 618 by a metal ring bolted to the tool body.

At the start of a pumping operation, probe 618 may be deployed by pressing rubber 702 against the wall of wellbore 104 to create a fluidic seal before pumping reservoir fluid from formation 106 into formation testing tool 100 through central flow area 706, probe channel 622, and fluid passageway 606 (e.g., referring to FIG. 6). Depending upon the shape of rubber 702, central flow area 706 may have any shape and dimensions including circular or oval shape, for example.

After reaching a pre-determined value of drilling fluid filtrate contamination in reservoir fluid from formation 106, inflatable barrier 704 may be inflated by pumping or injecting a hydraulic fluid or any fluid capable of inflating inflatable barrier 704 to form a fluidic seal with wellbore 104 by pressing inflatable barrier 704 against wellbore 104. Inflatable barrier 704 may be in between rubber 702 and central flow area 706 reducing its flow area. Inflatable barrier 704 may be mounted by an epoxy or a metal welding on the wire mesh end of probe 618.

Inflatable barrier 704 may be made of any material capable of withstanding differential pressure and providing a fluidic seal with wellbore 104 including rubber, wire mesh, Kevlar®, or any combination thereof, for example. Inflatable barrier 704 may withstand differential pressure from 10 psi (68,948 Pa) to 30 kpsi (206,842,800 Pa), from 500 psi (3,447,380 Pa) to 20 kpsi (137,895,200 Pa), from 1 kpsi (6,894,760 Pa) to 10 kpsi (68,947,600 Pa), from 2 kpsi (13,789,520 Pa) to 5 kpsi (34,473,800 Pa), or any range in between, for example. Inflatable barrier 704 may have any geometry or shape adapted to wellbore 104, the reservoir anisotropy, the reservoir heterogeneity, and the reservoir connectivity including circular shape, rectangular shape, elliptical shape, or any combination thereof, for example.

In embodiments, the shape of inflatable barrier 704 may be modified in real time depending upon its consequence on the flow of the formation fluid into central flow area 706 by pumping or injecting a hydraulic fluid or any fluid capable of inflating each part of inflatable barrier 704 to push the scaling material including rubber, wire mesh, Kevlar®, or any combination thereof, against wellbore 704. The hydraulic fluid or any fluid capable of inflating each part of inflatable barrier 704 may be transported in one of the chambers 640 (referring to FIG. 6), or reservoir fluid, for example. The pump used to inflate inflatable barrier 704 may be any pump capable of inflating inflatable barrier 704 including high-volume bidirectional pump 612 or low volume pump 626 (referring to FIG. 6). The shape of inflatable barrier 704 may be tunable by dividing inflatable barrier 704 into separate inflatable parts leading to any shape including circular, rectangular, or elliptical shape, for example.

Figure 7B:
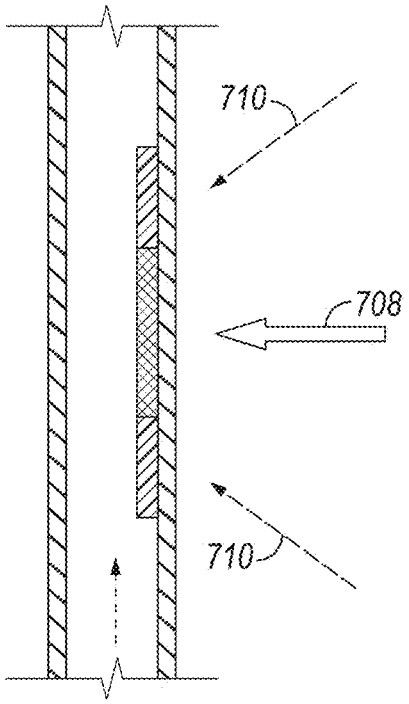
FIG. 7B is a schematic illustration of the interaction of the probe with the formation according to embodiments of the present disclosure.

FIG. 7B illustrates a schematic interaction of probe 618 with wellbore 104 and the consequences of the probe design on the reservoir fluid being extracted from formation 106 in a two-dimensional environment. As illustrated, inflatable barrier 704 is inflated and only reservoir fluid 708 flows into central flow area 706 into probe 618, while reservoir fluid 710 is prevented from flowing through central flow area 706 by inflatable barrier 704. It should be noted that reservoir fluid 708 has a much lower quantity of drilling fluid filtrate than reservoir fluid 710 after the initial pump-out. A workflow may be implemented in order to sample reservoir fluid 708 with as little contamination as possible.

Figure 8:
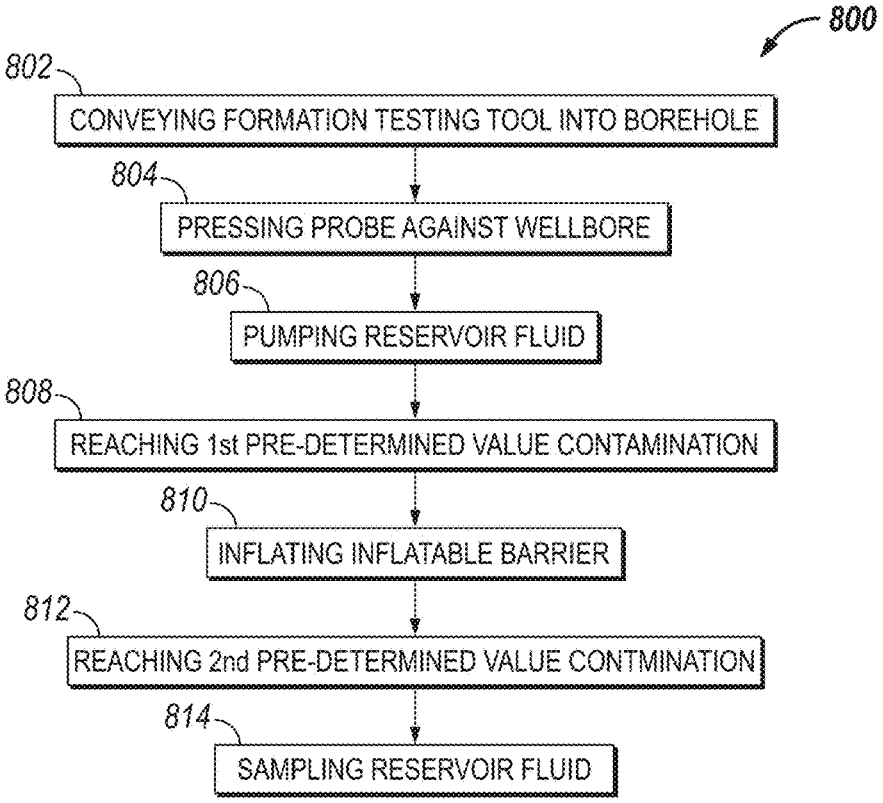
FIG. 8 is a workflow of an operation according to embodiments of the present disclosure.

FIG. 8 is a workflow 800 of a sampling operation using probe 618 in formation tester tool 100. It should be noted that workflow 800 may be performed by and/or controlled at least in part by information handling system 122. Workflow 800 may begin with block 802. In block 802, formation testing tool 100 is conveyed to a pre-determined sampling zone where probe 618 is pressed against the wellbore 104 in block 804 to create a fluidic seal between rubber 702 (referring to FIG. 7A) and wellbore 104. After reaching fluidic seal, workflow 800 moves to block 806 where reservoir fluid from formation 106 is extracted and pumped into central flow area 706 into formation testing tool 100 through probe channel 622 and fluid passageway 606 (referring to FIG. 6). As pumping continues, the contamination of the drilling fluid filtrate inside reservoir fluid 708 (referring to FIG. 7B) pumped inside central flow area 706 is monitored using non-optical fluid sensor 648 and/or optical measurement tool 634 depicted in fluid analysis module 118 of formation testing tool 100 in FIG. 6. The measurements taken by fluid analysis module 118 may be further analyzed and/or displayed by information handling system 122 according to the methods and systems described above.

After reaching a first pre-determined value of contamination of drilling fluid filtrate at block 808, workflow 800 moves to block 810 where inflatable barrier 704 is inflated to concentrate the reservoir fluid from the formation 106 into central flow area 706 (referring to FIG. 7A). Instructions to inflate inflatable barrier 704 based at least in part by first pre-determined value of contamination may be performed by information handling system 122. After inflatable barrier 704 has been inflated, reservoir fluid 708 (referring to FIG. 7B) may flow into central flow area 706 into probe 618, while reservoir fluid 710 may be prevented from flowing through central flow area 706 by inflatable barrier 704. It should be noted that reservoir fluid 708 has a much lower quantity of drilling fluid filtrate than reservoir fluid 710 after the initial pump-out. After reaching a second pre-determined value of contamination of drilling fluid filtrate inside reservoir fluid 708 pumped inside the central flow area at block 812, workflow 800 moves to block 814 where samples of reservoir fluid 708 taken during workflow 800 may be stored in in at least one of the chambers 640. Graphical representation of workflow 800 may further illustrate the identification of contamination level inside reservoir fluid 708 during sampling operations.

Figure 9:
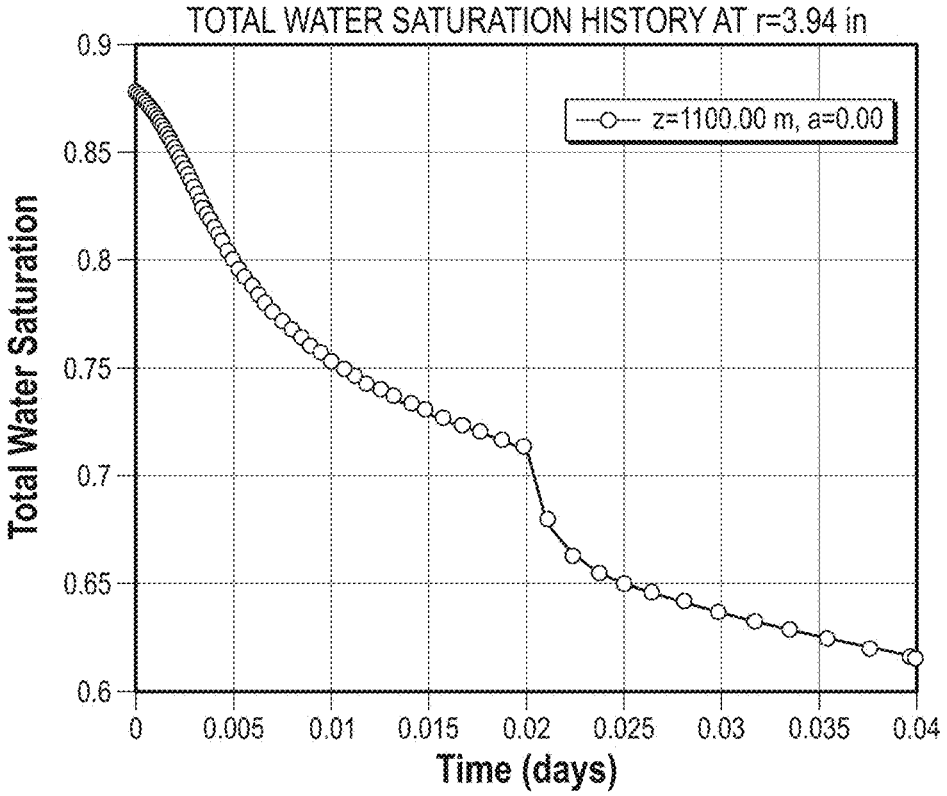
FIG. 9 is a numerical simulation of the water saturation level of a reservoir fluid inside a flow line detected by a fluid analyzer as a function of time according to embodiments of the present disclosure.

FIG. 9 is an example of a numerical simulation of the percentage of water saturation of reservoir fluid 708 detected by optical measurement tool 634 (e.g., referring to FIG. 6) as a function of time following workflow 800 from block 806 to block 812 (referring to FIG. 8). The numerical simulation was conducted to simulate the cleanup effect before and after inflating inflatable barrier 704 as reservoir fluid 708 is continuously pumped into formation testing tool 100 through probe channel 622 and fluid passageway 606 (referring to FIGS. 6, 7A, and 7B). In this simulation example, the pump-out clean-up process is simulated using an initial oil/water reservoir having a 60% water saturation before invasion by the drilling fluid filtrate produced by the water base mud during and after the drilling operation, which is simulated by a 87.5% water saturation around probe 618.

At the start of this example of pump-out operation, the invaded zone has a 87.5% water saturation corresponding to reservoir fluid 708 being contaminated by the drilling fluid filtrate. The curve shows the decline in the average water saturation of the formation around probe 618 during the clean-up process. The water saturation decreases continuously until reaching 71% at 0.02 day or 29 minutes. After 29 minutes, inflatable barrier 704 is inflated to pump reservoir fluid 708 from formation 106 into the central flow area 706 while reservoir fluid 710 is prevented from flowing through central flow area 706 by inflatable barrier 704 (referring to FIGS. 7A and 7B). As a result, the water saturation goes from 71% to 61% within the following 29 minutes, which is close to the initial oil/water reservoir of 60% water saturation before invasion by the drilling fluid filtrate. Therefore, the drilling fluid filtrate contamination in reservoir fluid 708 flowing through probe 618 is reduced suddenly and rapidly, enabling the fluid analysis of reservoir fluid 708 and/or sampling of relatively clean reservoir fluid 708 faster without prolonging pumping.

Figure 10:
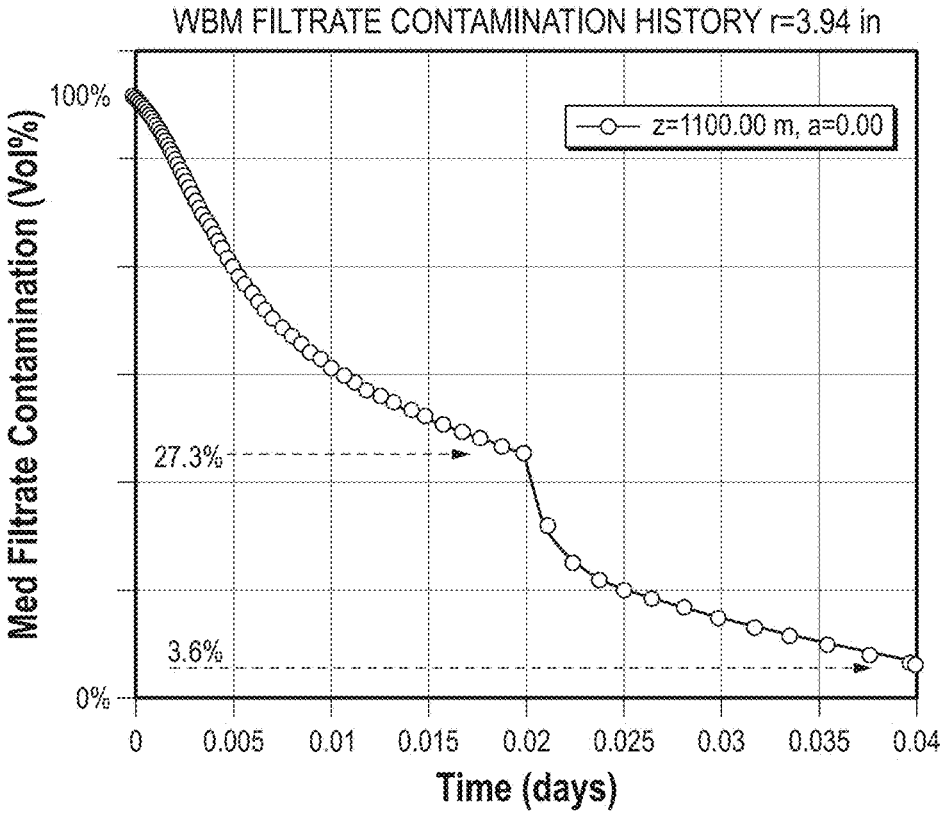
FIG. 10 is a numerical simulation of the contamination level of a reservoir fluid inside a flow line detected by a fluid analyzer as a function of time according to embodiments of the present disclosure.

FIG. 10 is an example of a numerical simulation of the percentage of drilling fluid filtrate contamination of reservoir fluid 708 detected by optical measurement tool 634 (e.g., referring to FIG. 6) as a function of time following workflow 800 from block 806 to block 812 (referring to FIG. 8). In FIG. 10, the same simulation was performed as the one described in FIG. 9 but converting the water saturation level to a percentage of drilling fluid filtrate contamination in reservoir fluid 708 as a function of pumping time. Two endmembers were used to convert water saturation data to volume-based contamination. The first endmember is 87.5% water saturation, which corresponds to reservoir fluid 708 in the invaded zone. The second endmember is 60% water saturation, which corresponds to the water saturation of pure reservoir fluid 708 (i.e., without any drilling fluid filtrate contamination). Therefore, the following calculation is performed for the conversion of water saturation depicted in FIG. 9 into a percent of the volume of drilling fluid filtrate contamination in reservoir fluid 708 in FIG. 10 as reservoir fluid 708 is continuously pumped into formation testing tool 100 through probe channel 622 and fluid passageway 606 (referring to FIGS. 6, 7A, and 7B):

vol. % contamination=((given saturation value−0.6)/(0.875−0.6)).

The drilling fluid filtrate contamination decreases continuously from 100% at the start of the pumping operation until reaching 27.3% at 0.02 day or 29 minutes. After 29 minutes, inflatable barrier 704 is inflated to pump reservoir fluid 708 from formation 106 into the central flow area 706 while reservoir fluid 710 is prevented from flowing through central flow area 706 by inflatable barrier 704 (referring to FIGS. 7A and 7B). As a result, the drilling fluid filtrate contamination goes from 27.3% to 3.6% within the following 29 minutes. 3.6% is calculated as follows (0.61−0.60)/(0.875−0.6). Therefore, the drilling fluid filtrate contamination in reservoir fluid 708 flowing through probe 618 is reduced suddenly and rapidly after 58 minutes and inflating inflatable barrier 704 after 29 minutes, enabling the acquisition or sampling of relatively clean reservoir fluid faster without prolonging pumping.

Figure 11:
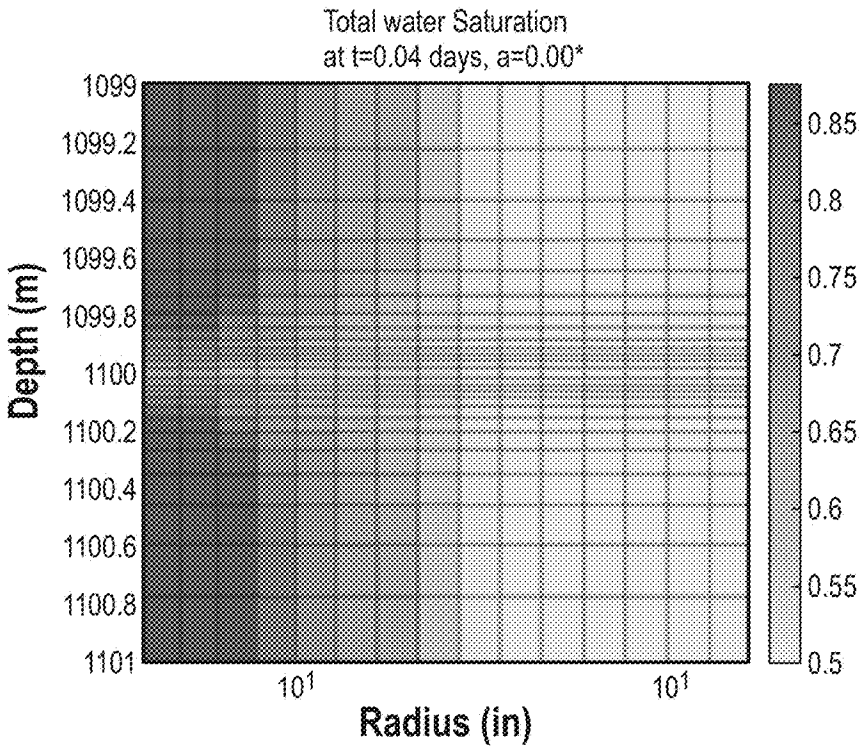
FIG. 11 is a numerical simulation before and after a pump-out operation in the near wellbore region as a function of depth versus radius around the probe according to embodiments of the present disclosure.
Figure 11:
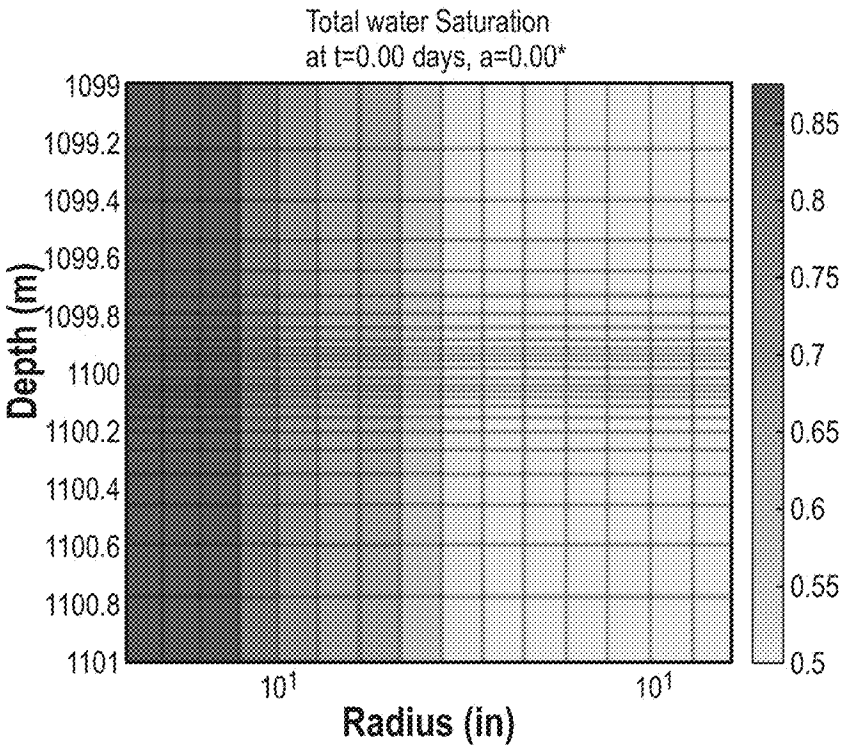

FIG. 11 is another example of a numerical simulation of the water saturation level of reservoir fluid 708 detected by optical measurement tool 634 (e.g., referring to FIG. 6) as a function of time following workflow 800 from block 806 to block 812 (referring to FIG. 8). The numerical simulation was conducted to simulate the cleanup effect before and after inflating inflatable barrier 704 as reservoir fluid 708 is continuously pumped into formation testing tool 100 through probe channel 622 and fluid passageway 606 (referring to FIGS. 6, 7A, and 7B). However, in this example, the water saturation level is monitored as a function of depth versus radius around probe 618 at the start of the pumping operation and after 58 minutes after inflating inflatable barrier 704 (referring to FIG. 7A) after 29 minutes as described in FIG. 9. Probe 618 is located around 1100 m in depth. At the beginning of the pump out operation, water saturation is around 87.5% around probe 618. However, water saturation drops to 61% after 58 minutes of pump-out operation. Further, water saturation goes rapidly from 61% to 87.5% even after pumping for 58 minutes as one moves away vertically from probe 618 located at 1100 m showing the sample cleaning efficiency of the pump-out operation with probe 618 and inflatable barrier 704 which was inflated after 29 minutes as described above.

Figure 12:
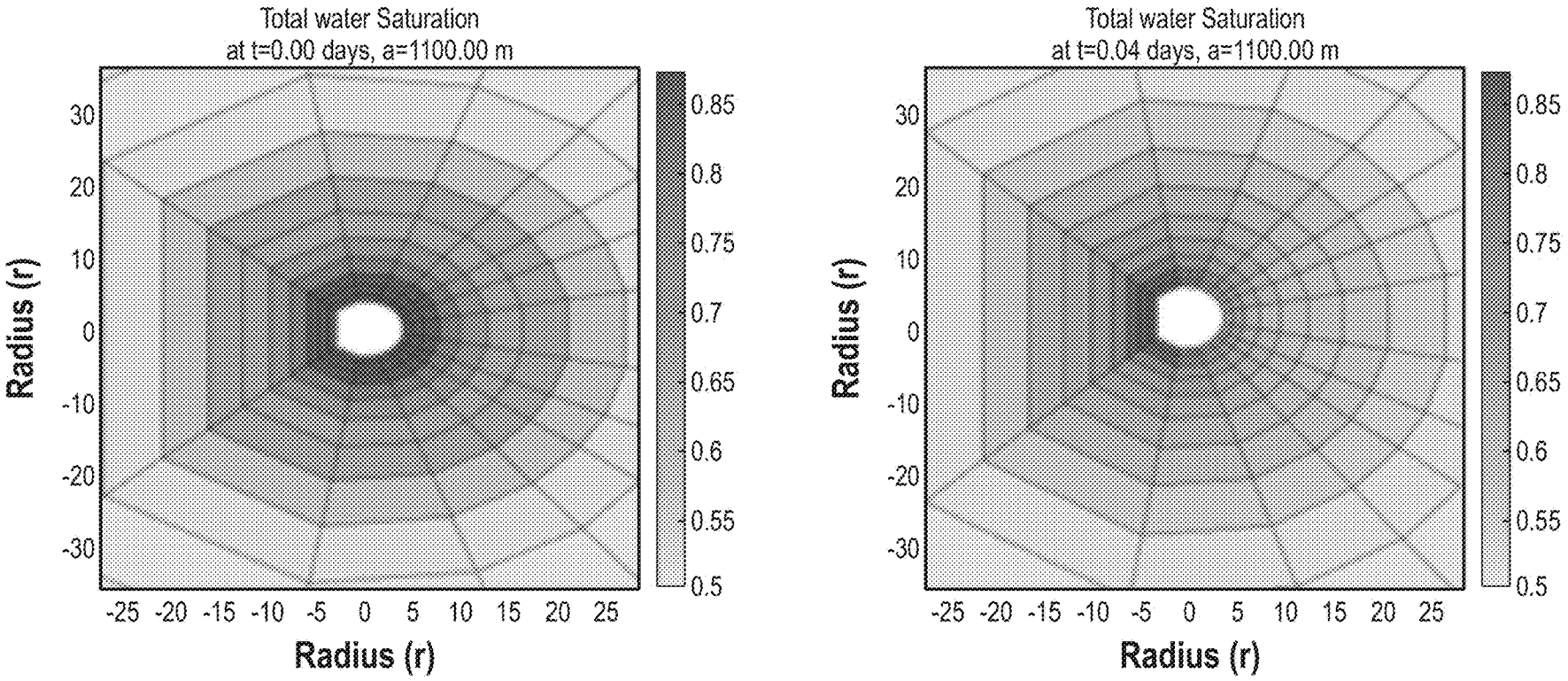
FIG. 12 is a numerical simulation before and after a pump-out operation in the near wellbore region in a radial view around the probe according to embodiments of the present disclosure.

FIG. 12 is another example of a numerical simulation of water-based mud filtrate into formation 106 (referring to FIG. 1) before and after a pump-out operation in the near wellbore 104 in a radial view around probe 618 after 58 minutes of pumping and inflating inflatable barrier 704 (referring to FIG. 7A) after 29 minutes following workflow 800 from block 806 to block 812 (referring to FIG. 8). The water saturation level is uniform at 87.5% (darkest color) around probe 618 at the beginning of the pump-out operation. However, after 58 minutes of pumping (after inflating inflatable barrier 704 after 29 minutes of pumping), the water saturation level drops to 61% in central flow area 706 corresponding to a radius from 0 inch to 10 inches on the abscissae and 0.675-0.725 inch on the ordinate. Probe 618 is still located around 1100 m in depth. Further, water saturation goes rapidly from 61% to 87.5% even after 58 minutes of pumping as one moves away radially from probe 618 showing the sample cleaning efficiency of the pump-out operation with probe 618 and inflatable barrier 704 which was inflated after 29 minutes as described above.

The preceding description provides various embodiments of systems and methods of use which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

Statement 1. A method comprising: conveying a formation testing tool into a wellbore, wherein the formation testing tool includes: a probe, wherein the probe comprises a rubber disposed on an outer perimeter of the probe and an inflatable barrier disposed between the rubber and a central area of the probe; and a fluid passageway; pressing the probe against the wellbore to create a fluidic seal in between a downhole formation and the fluid passageway; pumping reservoir fluid from the downhole formation from the probe to the fluid passageway; inflating the inflatable barrier after reaching a first pre-determined value of drilling fluid contamination in the reservoir fluid pumped from the downhole formation from the probe to the fluid passageway; and sampling a reservoir fluid when reaching a second value of drilling fluid contamination in the reservoir fluid pumped from the downhole formation from the probe to the fluid passageway Statement 2. The method of Statement 1, wherein the inflatable barrier comprises a material selected from a group of material consisting of rubber, wire mesh, Kevlar®, and any combination thereof.

Statement 3. The method of any one of previous Statements 1 or 2, wherein a shape of the inflatable barrier comprises a shape selected from a group of shape consisting of circular shape, rectangular shape, elliptical shape, and any combination thereof.

Statement 4. The method of any one of previous Statements 1-3, wherein the inflatable barrier comprises at least two inflatable parts that are inflatable at different time.

Statement 5. The method of any one of previous Statements 1-4, wherein the first pre-determined value of drilling fluid contamination in the reservoir fluid pumped from the downhole formation from the probe to the fluid passageway is from 20% to 8%.

Statement 6. The method of any one of previous Statements 1-5, wherein the first pre-determined value of drilling fluid contamination in the reservoir fluid pumped from the downhole formation from the probe to the fluid passageway is from 12% to 8%.

Statement 7. The method of any one of previous Statements 1-6, wherein the ratio of flow rates is increased from about 25% to a factor of about 5.

Statement 8. The method of any one of previous Statements 1-7, wherein a shape of the inflatable barrier is changed after reaching the second value of drilling fluid contamination in the reservoir fluid pumped from the downhole formation from the probe to the fluid passageway.

Statement 9. A system comprising: a formation testing tool comprising: a probe, wherein the probe comprises a rubber disposed on an outer perimeter of the probe and an inflatable barrier disposed between the rubber and a central area of the probe.

Statement 10. The system of Statement 9, wherein the inflatable barrier comprises a material selected from a group of material consisting of rubber, wire mesh, Kevlar®, and any combination thereof.

Statement 11. The system of Statement 9 or Statement 10, wherein a shape of the inflatable barrier comprises a shape selected from a group of shape consisting of circular shape, rectangular shape, elliptical shape, and any combination thereof.

Statement 12. The system of any one of Statements 9-11, wherein the inflatable barrier comprises at least two inflatable parts that are inflatable at different time.

Statement 13. The system of any one of Statements 9-12, further comprising at least one chamber comprising a fluid to inflate the inflatable barrier.

Statement 14. The system of any one of Statements 9-13, further comprising at least one sensor.

Statement 15. A non-transitory computer readable medium having data stored therein representing a software executable by a computer, the software executable comprising instructions comprising: instructions to pump reservoir fluid from a downhole formation from a probe to a fluid passageway of a formation testing tool, wherein the formation testing tool comprises: a probe comprising a rubber disposed on an outer perimeter of the probe and an inflatable barrier disposed between the rubber and a central area of the probe; and the fluid passageway; instructions to inflate the inflatable barrier after reaching a first pre-determined value of drilling fluid contamination in the reservoir fluid pumped from the downhole formation from the probe to the fluid passageway; and instructions to sample a reservoir fluid when reaching a second value of drilling fluid contamination in the reservoir fluid pumped from the downhole formation from the probe to the fluid passageway.

Statement 16. The non-transitory computer readable medium Statement 15, wherein the inflatable barrier comprises a material selected from a group of material consisting of rubber, wire mesh, Kevlar®, and any combination thereof.

Statement 17. The non-transitory computer readable medium of any one of Statements 15-16, wherein a shape of the inflatable barrier comprises a shape selected from a group of shape consisting of circular shape, rectangular shape, elliptical shape, and any combination thereof.

Statement 18. The non-transitory computer readable medium of any one of Statements 15-17, wherein the inflatable barrier comprises at least two inflatable parts that are inflatable at different time.

Statement 19. The non-transitory computer readable medium of any one of Statements 15-18, wherein the first pre-determined value of drilling fluid contamination in the reservoir fluid pumped from the downhole formation from the probe to the fluid passageway is from 20% to 8%.

Statement 20. The non-transitory computer readable medium of any one of Statements 15-19, wherein the first pre-determined value of drilling fluid contamination in the reservoir fluid pumped from the downhole formation from the probe to the fluid passageway is from 12% to 8%.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

Therefore, the present embodiments are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

conveying a formation testing tool into a wellbore, wherein the formation testing tool includes:

a probe, wherein the probe comprises a rubber disposed on an outer perimeter of the probe and an inflatable barrier disposed between the rubber and a central area of the probe; and a fluid passageway;

pressing the probe against the wellbore to create a fluidic seal in between a downhole formation and the fluid passageway;

pumping a reservoir fluid from the downhole formation from the probe to the fluid passageway;

inflating the inflatable barrier after reaching a first pre-determined value of drilling fluid contamination in the reservoir fluid pumped from the downhole formation from the probe to the fluid passageway; and sampling the reservoir fluid when reaching a second value of drilling fluid contamination in the reservoir fluid pumped from the downhole formation from the probe to the fluid passageway.

2. The method of claim 1, wherein the inflatable barrier comprises a material selected from a group of material consisting of a rubber, a wire mesh, an aramid, and any combination thereof.

3. The method of claim 1, wherein a shape of the inflatable barrier comprises a shape selected from a group of shape consisting of circular shape, rectangular shape, elliptical shape, and any combination thereof.

4. The method of claim 1, wherein the inflatable barrier comprises at least two inflatable parts that are inflatable at different time.

5. The method of claim 1, wherein the first pre-determined value of drilling fluid contamination in the reservoir fluid pumped from the downhole formation from the probe to the fluid passageway is from 20% to 8%.

6. The method of claim 1, wherein the first pre-determined value of drilling fluid contamination in the reservoir fluid pumped from the downhole formation from the probe to the fluid passageway is from 12% to 8%.

7. The method of claim 1, wherein a reduction of the central area of the probe is from 35% to 65% of an original surface area after inflating the inflatable barrier.

8. The method of claim 1, wherein a shape of the inflatable barrier is changed after reaching the second value of drilling fluid contamination in the reservoir fluid pumped from the downhole formation from the probe to the fluid passageway.

9. A non-transitory computer readable medium having data stored therein representing a software executable by a computer, the software executable comprising instructions comprising:

instructions to pump a reservoir fluid from a downhole formation from a probe to a fluid passageway of a formation testing tool, wherein the formation testing tool comprises:

the probe comprising a rubber disposed on an outer perimeter of the probe and an inflatable barrier disposed between the rubber and a central area of the probe; and the fluid passageway;

instructions to inflate the inflatable barrier after reaching a first pre-determined value of drilling fluid contamination in the reservoir fluid pumped from the downhole formation from the probe to the fluid passageway; and instructions to sample a reservoir fluid when reaching a second value of drilling fluid contamination in the reservoir fluid pumped from the downhole formation from the probe to the fluid passageway.

10. The non-transitory computer readable medium of claim 9, wherein the inflatable barrier comprises a material selected from a group of material consisting of rubber, wire mesh, aramid, and any combination thereof.

11. The non-transitory computer readable medium of claim 9, wherein a shape of the inflatable barrier comprises the shape selected from a group of shape consisting of a circular shape, a rectangular shape, an elliptical shape, and any combination thereof.

12. The non-transitory computer readable medium of claim 9, wherein the inflatable barrier comprises at least two inflatable parts that are inflatable at different time.

13. The non-transitory computer readable medium of claim 9, wherein the first pre-determined value of drilling fluid contamination in the reservoir fluid pumped from the downhole formation from the probe to the fluid passageway is from 20% to 8%.

14. The non-transitory computer readable medium of claim 9, wherein the first pre-determined value of drilling fluid contamination in the reservoir fluid pumped from the downhole formation from the probe to the fluid passageway is from 12% to 8%.

* * * * *